US009353455B2

(12) United States Patent
Kulinsky et al.

(10) Patent No.: US 9,353,455 B2
(45) Date of Patent: May 31, 2016

(54) DIELECTROPHORESIS AND ELECTRODEPOSITION PROCESS FOR SELECTIVE PARTICLE ENTRAPMENT

(71) Applicant: THE REGENTS OF THE UNIVERSITY OF CALIFORNIA, Oakland, CA (US)

(72) Inventors: Lawrence Kulinsky, Los Angeles, CA (US); Victor H. Perez-Gonzalez, Nuevo Leon (MX); Vinh Ho, Fountain Valley, CA (US)

(73) Assignee: THE REGENTS OF THE UNIVERSITY OF CALIFORNIA, Oakland, CA (US)

( * ) Notice: Subject to any disclaimer, the term of this patent is extended or adjusted under 35 U.S.C. 154(b) by 26 days.

(21) Appl. No.: 14/189,325

(22) Filed: Feb. 25, 2014

(65) Prior Publication Data

US 2014/0238858 A1 Aug. 28, 2014

Related U.S. Application Data

(60) Provisional application No. 61/769,657, filed on Feb. 26, 2013.

(51) Int. Cl.
*C25D 15/00* (2006.01)

(52) U.S. Cl.
CPC ..... *C25D 15/00* (2013.01)

(58) Field of Classification Search
CPC ..... C25D 15/00; C25D 13/04; C25D 5/04; C25D 1/003; C25D 13/22; C25D 13/00; C25D 5/022; B82Y 10/00; B82Y 30/00
See application file for complete search history.

(56) References Cited

U.S. PATENT DOCUMENTS

2009/0301883 A1* 12/2009 Chung et al. ..... 204/547
2011/0203936 A1 8/2011 Kulinsky et al.

OTHER PUBLICATIONS

Vidal et al "Electropolymerization of pyrrole and immobilization of glucose oxidase in a flow system: influence of the operating conditions on analytical performance", Biosensor & Bioelectronics, vol. 13, No. 3-4, p. 371-382, 1998.*

V. Ho, L. Kulinsky, and M. Madou, "Novel Fabrication Process of 3D Conductive Polymer Structures", Proceedings of Technologies for Future Micro-Nano Manufacturing, Napa, CA, Aug. 8-10, 2011.

Ho, V. et al. Novel Fabrication Technology for Three-Dimensional High Surface Area Pyrolyzed Structures, Proc. SPIE 7647, 76472F (2010).

(Continued)

*Primary Examiner* — Xiuyu Tai
(74) *Attorney, Agent, or Firm* — Vista IP Law Group LLP

(57) ABSTRACT

A method of creating a structure on an electrode includes exposing an electrode to a solution containing a polymerizable monomer and particles and applying an AC voltage to the electrode so as to induce positive DEP on the particles and to draw the particles toward the electrode. An offset voltage is applied to the electrode (which can be DC or AC) to form an electrically conductive polymer thereon from the polymerizable monomer, wherein the particles are entrapped on or within the polymer.

15 Claims, 8 Drawing Sheets

(56) References Cited

OTHER PUBLICATIONS

Ho, V. et al., Utilization of Electroactive Polymer Actuators in Micromixing and in Extended-Life Biosensor Applications, Proc. SPIE 7647, 764735 (2010).

Perez-Gonzalez, V. et al. 3D Carbon Cages for Dielectrophoretic-Based Bioparticle Separation/Concentration Applications, Proceedings of AIChE Annual Meeting Conference, New York, NY, AIChE (2012).

Pere-Gonzalez, V. et al., PPyDEP: a new approach to microparticle manipulation employing polymer-based electrodes, DOI: 10.1039/c3lc50893e, Lab on Chip, (2013) (11pages).

Perez-Gonzalez, V. et al., PPyDEP: a new approach to microparticle manipulation employing polymer-based electrodes, Lab Chip, 2013, 13, 4642.

Ho, V. et al., Fabrication of 3D polypyrrole microstructures and their utilization as electrodes in supercapacitors, J. Micromech. Microeng. 23 (2013) 125029 (7pp).

* cited by examiner

DIELECTROPHORESIS AND ELECTRODEPOSITION PROCESS FOR SELECTIVE PARTICLE ENTRAPMENT

RELATED APPLICATION

This application claims priority to U.S. Provisional Patent Application No. 61/769,657 filed on Feb. 26, 2013, which is hereby incorporated by reference in its entirety. Priority is claimed pursuant to 35 U.S.C. §119.

FIELD OF THE INVENTION

The field of the invention generally relates to micro- and nano-fabrication processes and methods used to control surface morphology of the fabricated surface features. The field of the invention also relates to functional devices formed using the processes and methods described herein (e.g., sensors, biosensors, and the like).

BACKGROUND

Currently there is a lack of a fast, efficient, and scalable manufacturing process for adding micro-features to electrode systems. Wet and dry etching processes have been employed with various degrees of success. Dry etching typically consists of performing an oxygen plasma etching process over the underlying structure. Plasma etching has been successfully applied to improve the response of electrochemical sensors through an increase of their hydrophilicity. However, this technique will only increase the access of the solution to small porosities already available in the underlying base material, but will not significantly affect total surface area (e.g., features size is too small). Another option may be found on electrochemical pretreatment (ECP), however, exposing a conductive structure to a DC potential while immersed in a basic solution causes breakage in the structure, causing permanent damage. A competing approach is to develop three-dimensional (3D) structures, such as posts or walls with high aspect ratio that increase the surface area; examples include, but are not limited to, arrays of posts and multilayer structures. U.S. Patent Application Publication No. 2011/0203936, for example, discloses a method of making polymer-based high surface area multi-layered three-dimensional structures.

Further patterning of these three-dimensional structures might include organic beads deposited on the substrate from a liquid phase. When the liquid solution evaporates the beads are left on the surface, but the attachment is very weak and beads soon fall out. Various techniques have also been employed to increase the surface area by producing etch pits of controlled geometry. Several of the processes listed above suffer from limitations and drawbacks such as damage of the structures, long processing time, insufficient control over the desired features, complexity of the processes, and high energy consumption.

SUMMARY

In one embodiment, a method of creating a structure on an electrode includes exposing an electrode to a solution containing a polymerizable monomer and particles and applying an Alternating Current (AC) voltage to the electrode so as to induce positive dielectrophoresis (DEP) on the particles and to draw the particles toward the electrode. A superimposed offset voltage, which can be either AC or Direct Current (DC) is applied to the electrode to perform electrodeposition (ED) of an electrically conductive polymer thereon from the polymerizable monomer, wherein the particles are entrapped on or within the polymer.

In another embodiment, a method of creating a structure on an electrode includes exposing an electrode to a solution containing a polymerizable monomer and a first plurality of particles. A first AC voltage is applied to the electrode so as to induce positive DEP on the first plurality of particles and draw the first plurality of particles toward the electrode. A first superimposed voltage offset is applied to the electrode to form an electrically conductive polymer thereon from the polymerizable monomer, wherein the first plurality of particles are entrapped on or within the electrically conductive polymer. The electrode then exposed to a solution containing the polymerizable monomer and a second plurality of particles. A second AC voltage is applied to the electrode so as to induce positive DEP on the second plurality of particles and draw the second plurality of particles toward the electrode. A second superimposed voltage offset is applied to the electrode to form an electrically conductive polymer thereon from the polymerizable monomer, wherein the second plurality of particles are entrapped on or within the electrically conductive polymer. The first and second voltage offsets may be DC or AC voltage offsets.

The process described above may be repeated any number of times to create multiple layers. In addition, the second plurality of particles may be different from the first plurality of particles. In this regard, hierarchical layers can be created through this process.

DETAILED DESCRIPTION OF THE ILLUSTRATED EMBODIMENTS

Figure 1A:
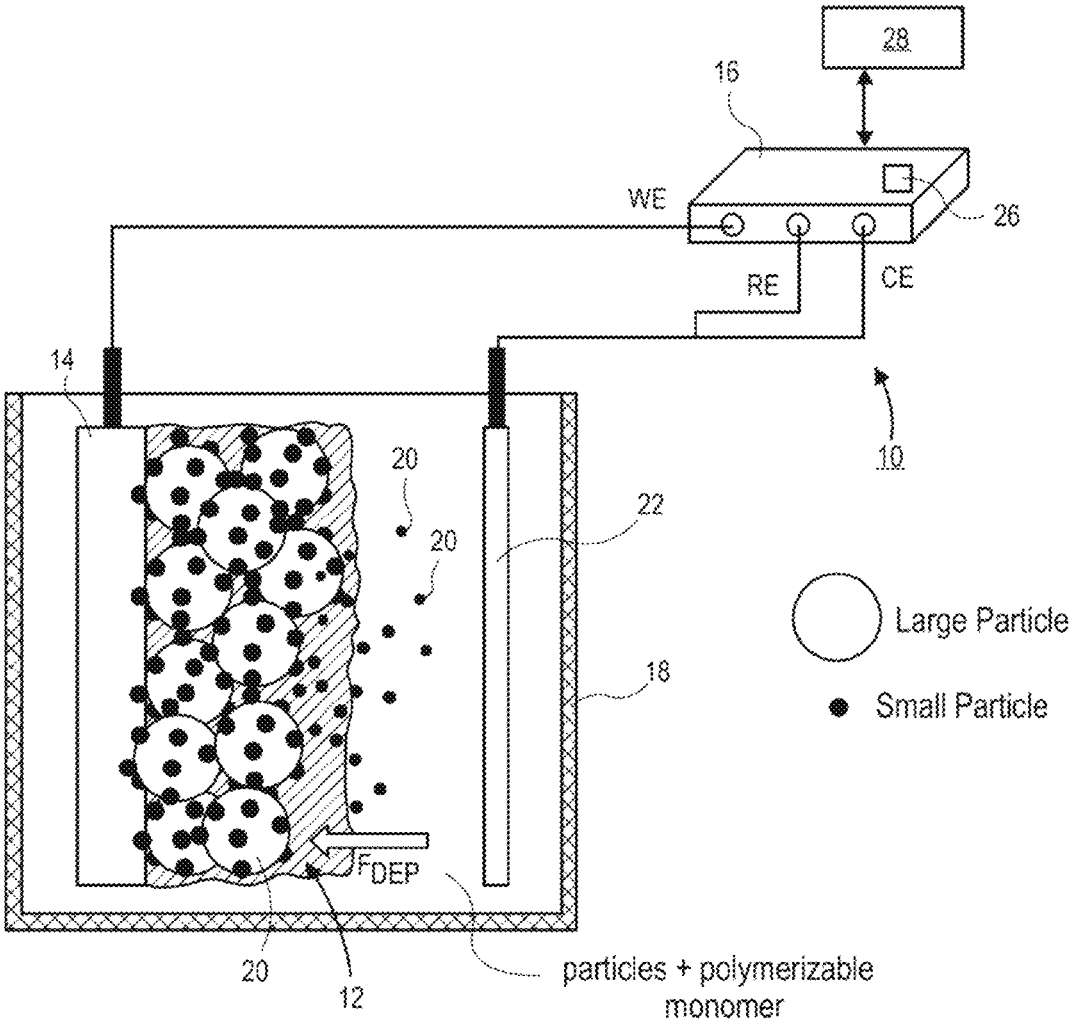
FIG. 1A illustrates a schematic representation of a device used to form a structure on an electrode according to one embodiment.
Figure 1B:
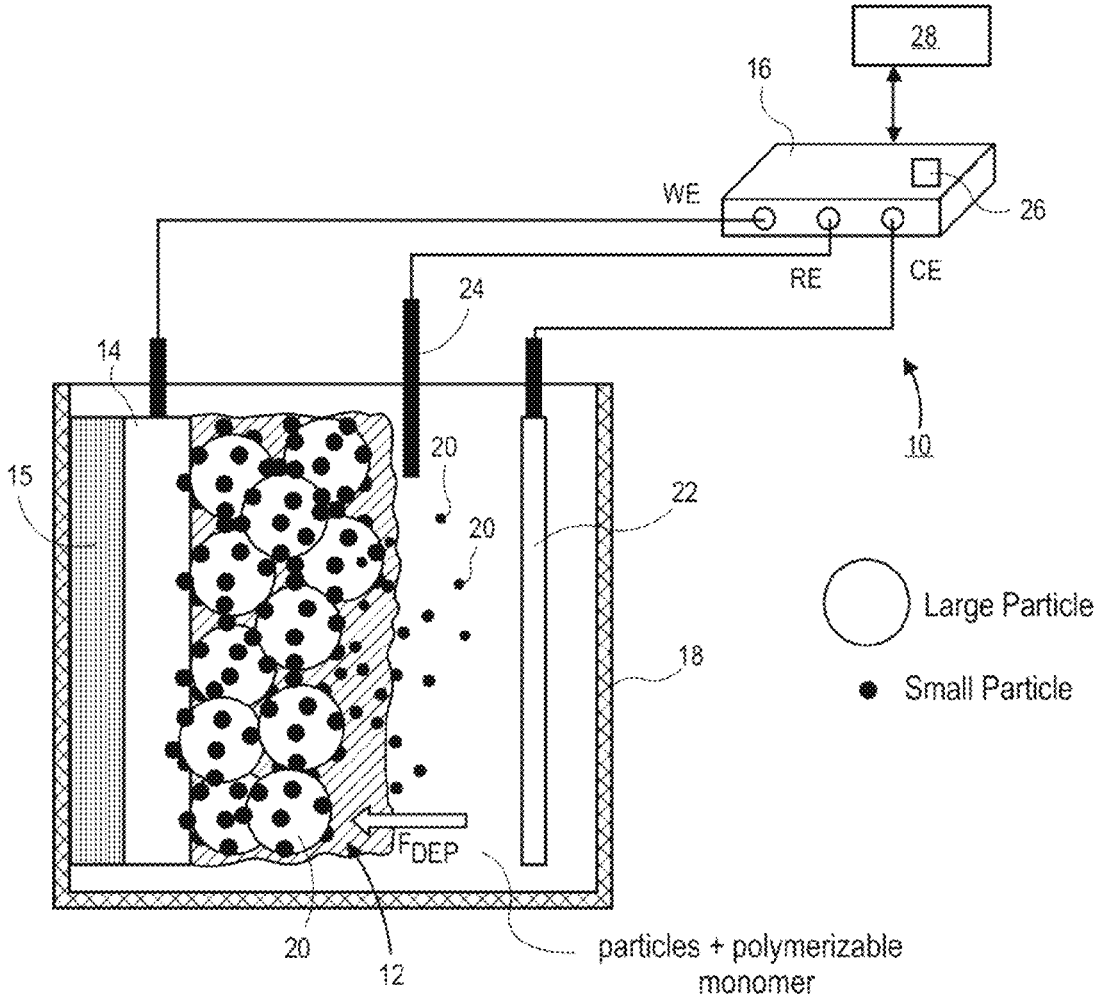
FIG. 1B illustrates a schematic representation of a device used to form a structure on an electrode according to another embodiment.

FIGS. 1A and 1B illustrates a device 10 used to form a structure 12 on an electrode 14. The device 10 includes a function generator 16 that is used to apply a voltage to an electrode 14 that is exposed to a solution as described below. The electrode 14 may optionally be disposed on a substrate 15 as illustrated in FIG. 1B and FIGS. 3A-3D. The substrate 15 may include a non-conductive material such as glass or a polymer. As explained herein, the function generator 16 applies both an AC signal as well as a superimposed signal in the form of an offset voltage to the electrode 14. The superimposed signal may include a DC offset voltage or, alternatively, it may include an AC offset voltage. An example of a function generator 16 that can be used includes the DS345 available from Stanford Research Systems of Sunnyvale, Calif. though it should be understood that a wide variety of function generators 16 may be used. As an alternative to a single function generator 16 that applies both the AC signal to induce DEP and the superimposed signal (e.g., offset voltage) to deposit polymer, two separate devices may be used. In this alternative, an AC signal generator may be used to supply the AC signal while a separate power source will apply the superimposed signal in conjunction with the AC signal generator. The two voltage sources can be applied simultaneously or, alternatively, the AC signal may be on while the signal to be superimposed is off. The device 10 further includes a solution holder 18 that is used to hold a fluid solution that contains particles 20 and a polymerizable monomer (described herein) that is in contact with the electrode 14. As used herein, a particle 20 refers to small objects which may be inanimate or living. Particles 20 may be inorganic, organic, biological or some combination thereof. Particles 20 may include nanometer or micrometer sized objects. In some embodiments, particles 20 may have functional chemical groups (e.g., carboxyl, alkyl, hydroxyl), proteins, antibodies, enzymes, or nucleic acid (e.g., DNA, RNA). Particles 20 may also include composite structures such as beads or other particles conjugated to cells, viruses, or the like. FIG. 1A illustrates different sized particles 20 include a large particle 20 and a small particle 20.

The electrode 14 may be formed from any number of materials including, for example, metals typically employed for electrodes, such as gold or nickel traces as well as carbon electrodes. While only a single electrode is illustrated in FIG. 1, in other embodiments, the device 10 may include multiple electrodes 14. For example, different electrodes could be multiplexed with the function generator 16 and driven at different frequencies, peak-to-peak voltages, superimposed signals, and the like (See FIG. 3C). In one particular example, the electrode 14 is referred to as the working electrode. A counter or auxiliary electrode 22 is coupled to the function generator 16 as well and is in contact with the same fluid that contacts the electrode 14. A reference electrode 24 may also be used, as illustrated in FIG. 1B. The counter electrode 22 (for example, made of gold, platinum, or carbon) and optional reference electrode 24 (for example, Saturated Calomel Electrode or Ag/AgCl electrode).

The function generator 16 may optionally include a switch 26 that is used to selectively apply the superimposed offset voltage(s) as described herein. The switch 26 may be a button or the like that is manually actuated. Alternatively, the function generator 16 may be operably connected to a controller or other computer 28 that is used to program various operational parameters of the function generator 16 including the sequence of the superimposed offset voltage(s).

In one aspect, the solution holder 18 may be configured to hold the fluids in a batch mode whereby the mixture of fluids described herein are added and removed in batches. Alternatively, the solution holder 18 may be configured to hold the fluids in a continuous mode such that solution holder 18 is a flow cell like that illustrated in FIGS. 3A-3C. For example, fluids may be pumped into the solution holder 18 via an inlet 32 and removed via an outlet 34. In this manner, different fluids or fluid mixtures can be quickly altered or changed. Moreover, in some instances, the entire device 10 may be constructed as a relatively small microfluidic device in which the solution holder 18 is a flow channel, flow cell, chamber, or the like through which fluid can be pumped using syringe pumps, electro-osmotic micropumps, or the like.

The device 10 and fabrication process described herein include several main features including: (1) control of microstructure and surface morphology, (2) flexibility in the selection of materials to employ, and (3) low processing time. This was achieved through the combination of two techniques that are employed using the electrode 14: DEP and ED.

DEP can be described as phenomenon where a force is exerted on polarizable particles 20 when subjected to a spatially non-uniform electric field. For DEP to occur, the particles 20 must be immersed into a polarizable suspending medium. The DEP force can be positive or negative depending on the relation between the electric properties of the particles 20 and suspending medium. When the particle 20 is more polarizable than the suspending medium, the DEP force is positive, resulting in particle motion towards the zones of highest gradient of the square of the electric field (toward the electrode as indicated by the arrow of FIG. 1A), whereas for particles 20 less polarizable than the suspending medium, the force is negative repelling the particles from such zones. DEP is defined by the expression, $$F_{DEP}=2\pi r^3\epsilon_m Re\{K\}\nabla E_{RMS}^2 \quad (1)$$

where r is the particle 20 radius, $\epsilon_m$ is the suspending medium permittivity, K is the complex Clausius Mossotti Factor and E is the electric field. The Clausius Mossotti factor is defined as:

$$K=\frac{\varepsilon_p^*-\varepsilon_m^*}{\varepsilon_p^*+2\varepsilon_m^*} \quad (2)$$

$$\varepsilon^*=\varepsilon-j\sigma/\omega \quad (3)$$

In Equation (2) $\epsilon^*$ stands for complex permittivity and subscripts p and m refer to particle and suspending medium respectively. Equation (3) describes the complex permittivity as a function of electrical permittivity $\epsilon$, electrical conductivity $\sigma$, and $\omega$ is the angular frequency of the electrical signal. It is evident that DEP is a frequency dependent force. The electric bias employed to produce DEP can be either DC or AC.

ED is a technique that allows monomers to be polymerized through the application of an electric potential between the working electrode 14 and the counter-electrode 22 placed in the solution. The polymerizable monomer in solution forms an electrically conductive polymer on the working electrode 14. The deposited polymer may include a complete layer of the polymer or a partial layer of the polymer. This process can be combined with standard photolithography techniques to develop conductive three-dimensional (3D) structures such as those described in U.S. Patent Application Publication No. 2011/0203936 which is incorporated by reference herein. Electrodeposition is an appealing technique for microfabrication due to its simplicity, low deposition voltage (typically less than 1V vs. Ag/AgCl reference electrode), ability to control film thickness, and porosity of the film, and its capability to synthesize a polymer on any electrically conductive substrate.

In one aspect of the invention, the method of forming a structure on the electrode 14 employs DEP to attract particles 20 towards the electrode(s) 14 on which the particles 20 are to become permanently entrapped. In contrast to conventional DEP, where the suspending medium consists of deionized (DI) water, or buffer solutions (e.g., Phosphate Buffered Saline [PBS]), and its conductivity is controlled by the addition of salts, the particles 20 are immersed in a solution containing the polymerizable monomer and an optional dopant. The dopant may be omitted in some instances though omission of the dopant may result in reduced conductivity and thus reduced deposition rate. However, in some other alternative embodiments, the absence of a dopant may be preferred.

An example of a dopant may include Dodecyl-Benzene-Sulfonate-ion (DBS) although other ions may be used (such as chloride, bromide, polystyrene sulfonate, hexafluoroforsphate, etc.). The monomer may include pyrrole which is then polymerized to polypyrrole, a conductive polymer. Additional examples of polymerized monomers and their polymeric forms are aniline/polyaniline, thiohene/polythiophene, and other conducting polymers undergoing electrochemical polymerization.

With reference to FIG. 1, a method of forming a structure on the electrode 14 includes the operation of exposing the electrode 14 to a fluid solution containing a polymerizable monomer and particles 20. Using the function generator 16, an AC voltage is applied to the electrode 14 so as to induce positive DEP on the particles 20 so as to draw the particles 20 toward the electrode 14. Typically, for microelectrodes the AC voltage has a peak-to-peak amplitude within the range of about 1V to about 50 V. The AC voltage may have a varied frequency, typically within the range of about 500 Hz to about 50 MHz. Next, the function generator 16 applies the offset voltage to the electrode 14. The offset voltage is typically in the range of between about 0.6 and 1.2 V (DC) when pyrrole is used as the monomer. The applied voltage determines the deposition rate of the polymer film as well as the porosity of the film. It should be understood that different monomers may use a DC offset voltage outside of this range. The offset voltage is applied for an extended period of time so as to form the electrically conductive polymer 30 on the electrode 14 with the particles 20 entrapped on or contained within the newly created electrically conductive polymer layer 30. Typically, the offset voltage is applied for a period of time between several seconds to several minutes. The amount of time that the offset voltage is applied affects the thickness of the polymer layer (entrapping the particles 20) onto the electrode 14. In some instances, it may be desirable to create a fully formed layer of electrically conductive polymer 30 on the electrode 14 in which case the offset voltage is applied for a longer period of time. Conversely, it may sometimes be desirable to expose particles 20 more directly on the outer surface of the structure where the offset voltage is applied for a shorter period of time. In the latter instance, electrically conductive polymer 30 may partially or incompletely form.

Figure 8:
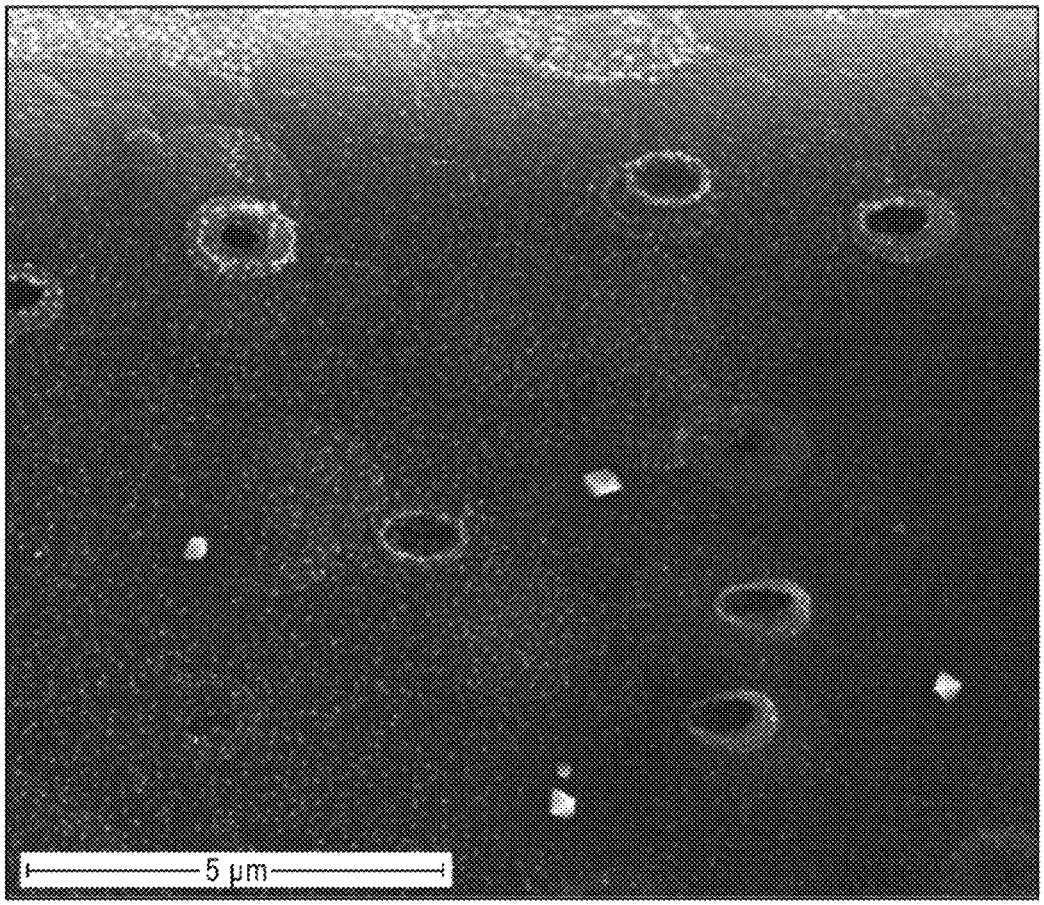
FIG. 8 illustrates an image of pyrolized PPy-derived carbon layer showing apertures where polystyrene beads were vaporized.

In some embodiments, the formed structure may then be heated in an inert environment to pyrolize the polymer to form a carbonized electrode 14. FIG. 8 herein illustrates a carbonized electrode 14 that incorporates an optional pyrolysis step.

Figure 2:
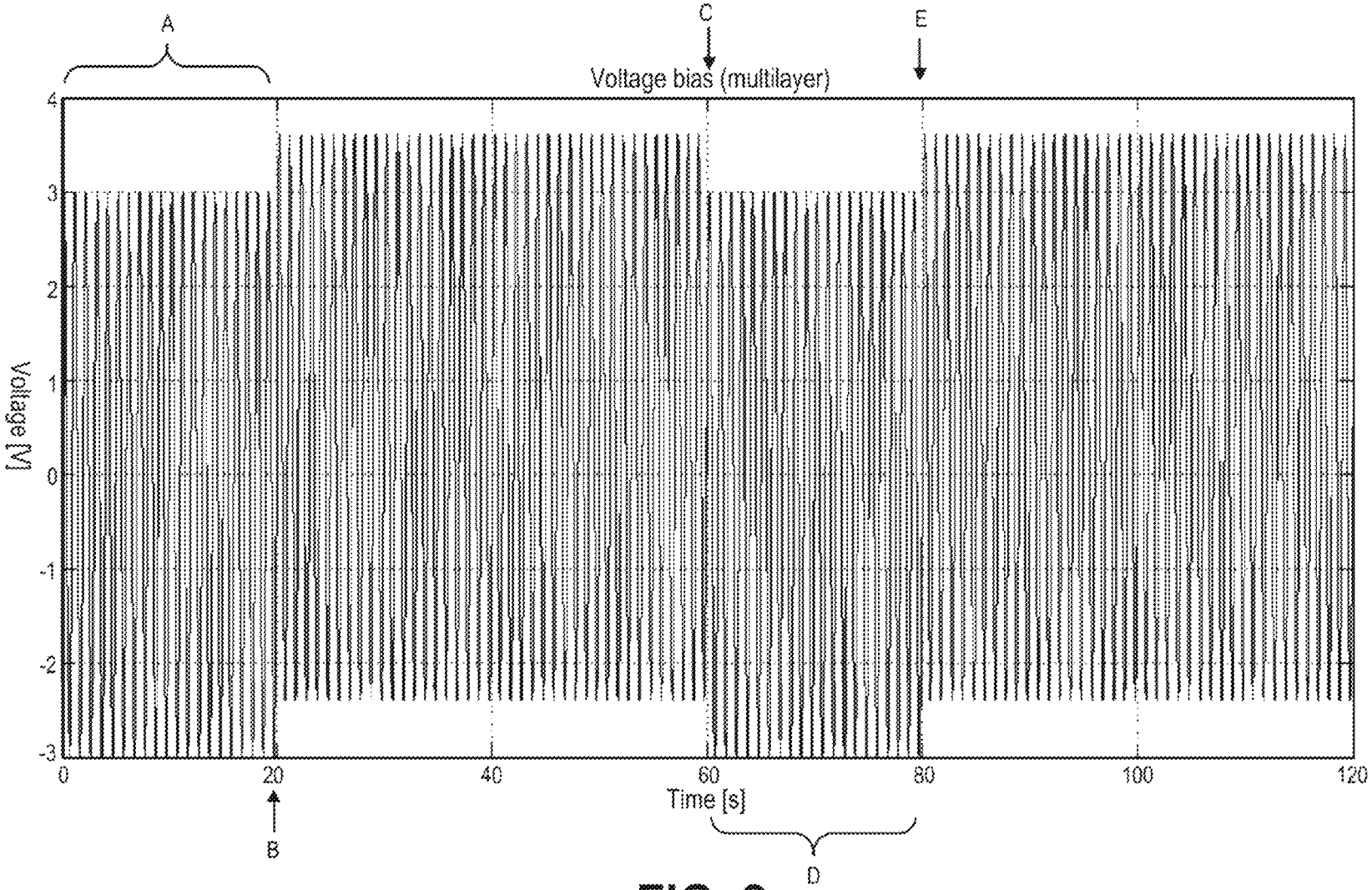
FIG. 2 illustrates a graph of voltage as a function of time illustrating application of the AC voltage as well as the DC offset to create a multilayer structure.

FIG. 2 illustrates a graph of the applied voltage to the electrode 14 as function of time. It should be understood, however, that the frequency of the AC voltage has been significantly lowered for illustration purposes. As seen in region A FIG. 2, an AC voltage (alternating between positive and negative) is applied to the electrode 14 so as to induce positive DEP on the particles 20 and to draw the particles 20 toward the electrode 14. At point B as seen in FIG. 2, the DC offset voltage is applied, which in this particular instances, lasts about forty (40) seconds. It should be understood that the offset voltage can be time varying (AC) as to achieve different morphological, mechanical, and electrical properties in the deposited film. At point C, the DC offset voltage is turned off. Turning off the DC offset stops the deposition of the electrically conductive polymer 30 on the electrode 14 (or structure being formed). During phase D as illustrated in FIG. 2, positive DEP is again induced on the particles 20 so as to draw the particles 20 toward the electrode 14. At point E in FIG. 2, the DC offset voltage is again turned on. In this manner, a multilayer structure may be formed as is illustrated in FIG. 1. It should be understood that the electrically conductive polymer 30 that is deposited is porous enough to allow transport of reactants and analytes in the solution to the underlying electrode.

In the waveform of FIG. 2, the AC voltage is continuously on regardless of whether the DC offset voltage is turned on or off. In this embodiment, a positive DEP force is thus always being applied to the particles 20. Alternatively, the AC voltage may be turned off during the time period when the DC offset voltage is applied. Of course, stopping the AC voltage during application of the DC offset will prevent the continuous application of the positive DEP force.

Figure 3A:
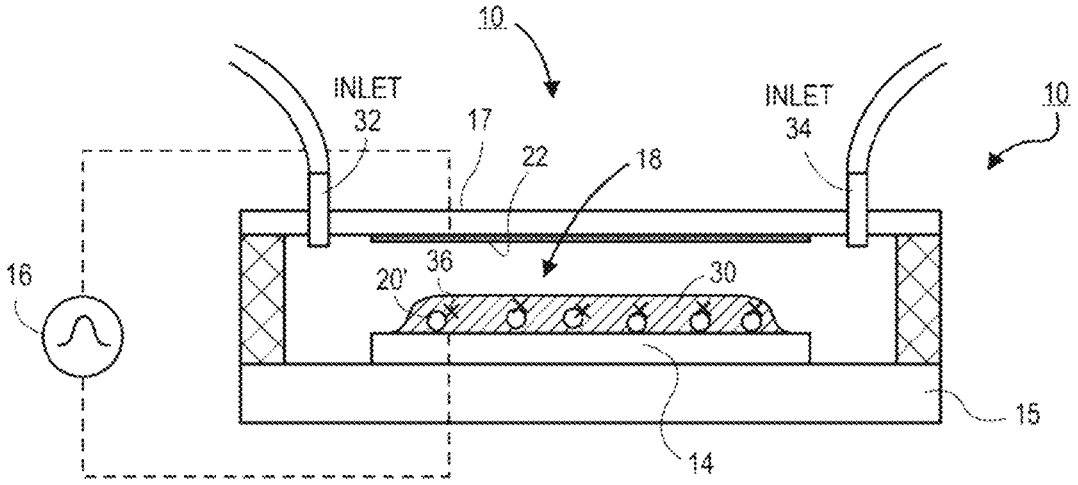
FIG. 3A illustrates another embodiment of a device wherein particles can be flowed into the device.
Figure 3B:
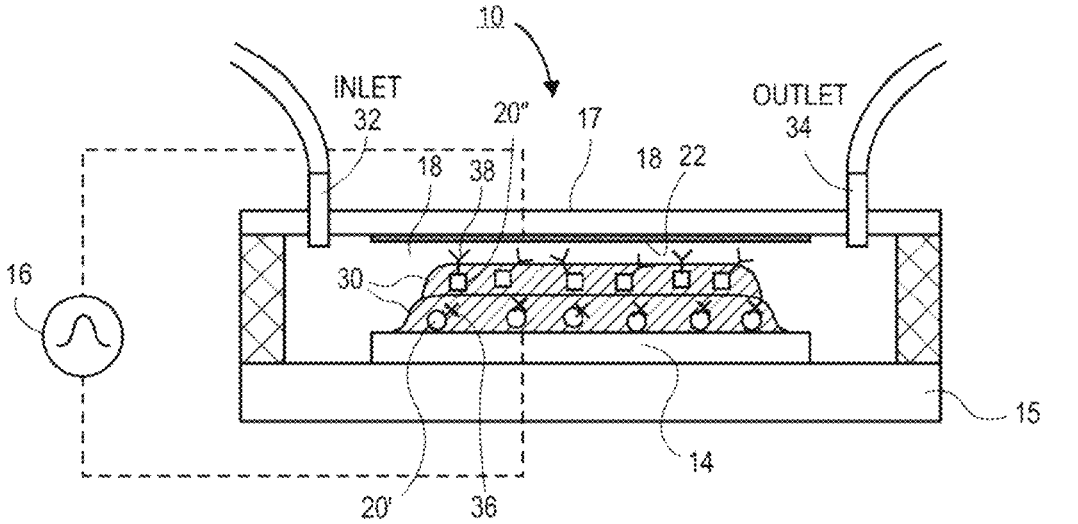
FIG. 3B illustrates the device of FIG. 3A with a second set of different particles being flowed into the device and deposited on the formed structure.

FIGS. 3A and 3B illustrate another embodiment of a device 10. In this device 10, an inlet 32 and an outlet 34 are provided in the solution holder 18 that takes the form of a flow cell. Within the flow cell 18 a working electrode 14 is positioned on a substrate 15. The counter electrode 22 is positioned opposite the working electrode in, for example, a cover 17. In this embodiment, a first plurality of particles 20' that are functionalized to a molecule 36 (e.g., functionalized beads) are flowed through the solution holder 18 while DEP is applied to attract the particles 20' to the electrode 14. A DC offset voltage is applied as explained herein to entrap the particles 20' on or within the electrically conductive polymer 30 formed on the electrode 14. Next, a second plurality of particles 20" that are functionalized to another molecule 38 is then flowed through the solution holder 18 while DEP is applied to attract the second plurality of particles 20" toward the electrode 14 or newly formed structure. A DC offset voltage is applied as explained herein to entrap the second plurality of particles 20" on or within a layer of electrically conductive polymer 30. While two (2) such layers are illustrated as being formed in FIG. 3B additional sequences of this process may be applied for additional sets of particles 20 in additional layers or levels. Further, this embodiment does not need to have particles 20 functionalized to a molecule 36. Any type of particle 20 (whether or not conjugated or functionalized) can be used.

Figure 3D:
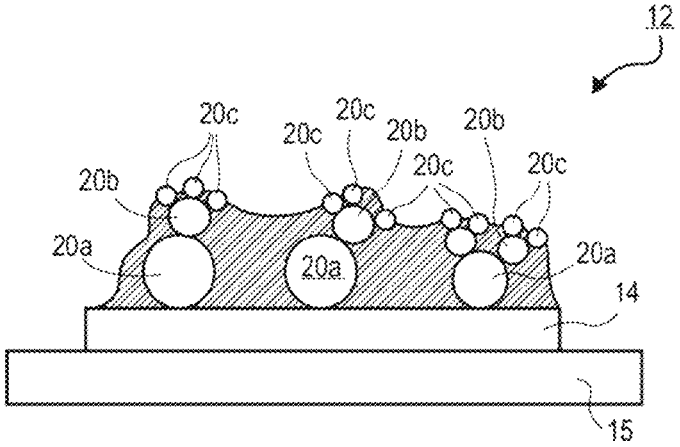
FIG. 3D illustrates an electrode having formed thereon on fractal-like structure in which particles having different sizes were successively deposit in the electrically conductive polymer.
Figure 3C:
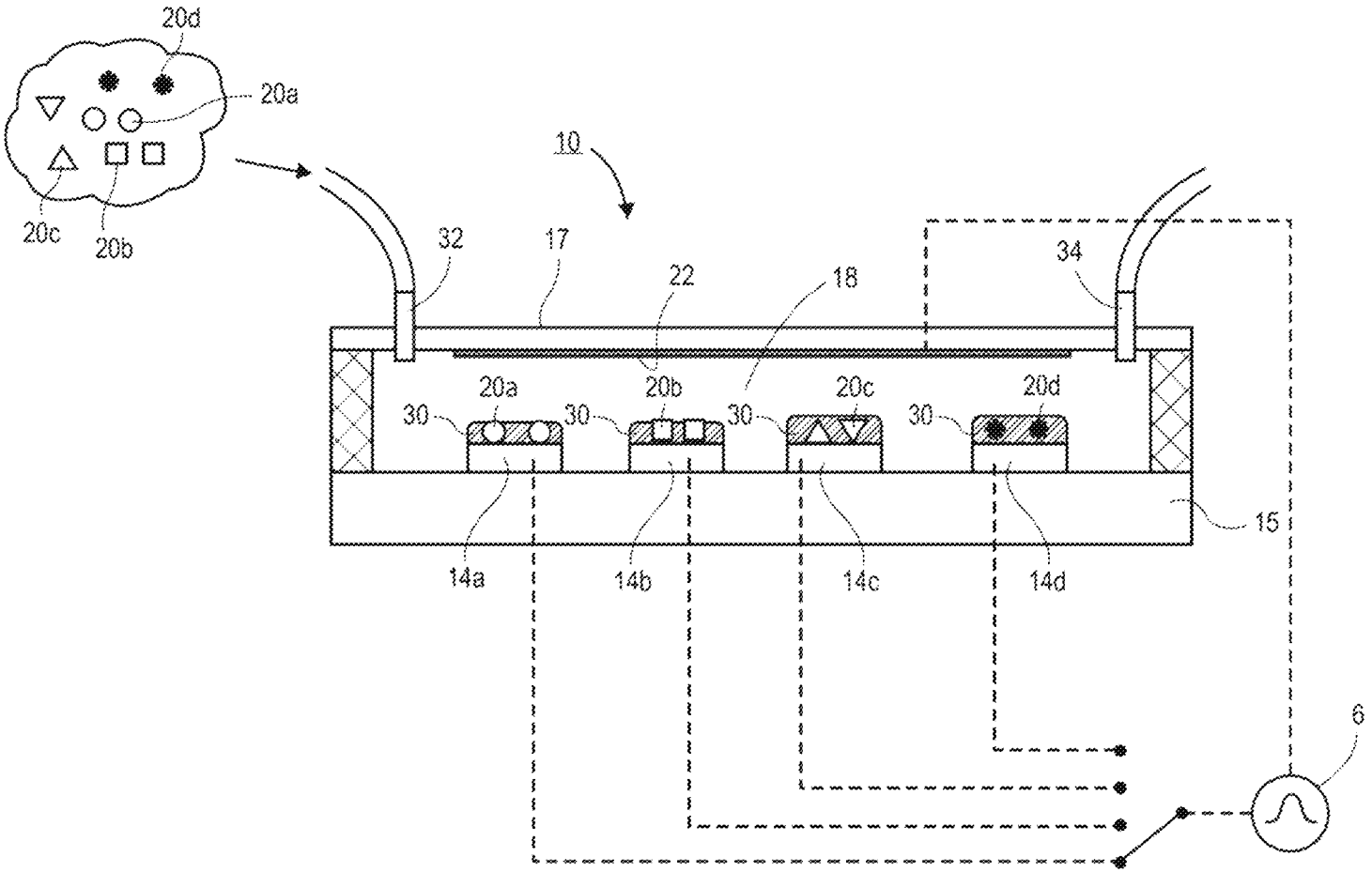
FIG. 3C illustrates a fractal-like structure formed on an electrode according to one embodiment of the invention.

FIG. 3C illustrates another alternative embodiment of a device 10. In this embodiment, there are a plurality of different electrodes 14*a*, 14*b*, 14*c*, 14*d*. Each electrode 14*a*, 14*b*, 14*c*, 14*d* can be selectively coupled to the function generator 16 using switching circuitry or the like known to those skilled in the art. A counter electrode 22 is positioned opposite the electrodes 14*a*, 14*b*, 14*c*, 14*d* on a cover 17. As seen in FIG.

3C, different particles 20*a*, 20*b*, 20*c*, 20*d* can be introduced into the flow cell 18 and electrical activation of the electrodes 14*a*, 14*b*, 14*c*, 14*d* is able to selectively deposit the particles 20*a*, 20*b*, 20*c*, 20*d* on an electrode of choice. For example, particles 20*a* can be flowed through the device and electrode 14*a* can be activated with an AC voltage for DEP attraction of particle 20*a* followed by entrapment within the electrically conductive polymer by application of the offset voltage as described herein. The same process can be used to deposit particles 20*b*, 20*c*, and 20*d* on electrodes 14*b*, 14*c*, and 14*d*, respectively. Each particle 20*a*, 20*b*, 20*c*, 20*d*, for example, may be different or be functionalized or conjugated with different molecules. In this regard, a single device 10 is formed that can be used as a sensor, for example, to detect a multitude of different targets.

FIG. 3D illustrates an electrode 14 having formed thereon on fractal-like structure in which particles 20*a*, 20*b*, 20*c* having different sizes were successively deposited in the electrically conductive polymer 30. In this particular embodiment, a larger particle 20*a* is deposited first, followed by a smaller particle 20*b* which is followed by yet a smaller particle 20*c*. This process can be repeated for any number of different particles 20. Moreover, it is not necessary that progressively smaller particles 20 be deposited. Different types and sizes of particles 20 can be deposited in whatever desired order to produce the final structure 12.

Experimental Results

A device 10 like that illustrated in FIG. 1 was used to deposit various types of particles on an electrode. In these examples, the dopant Sodium Dodecyl-Benzene-Sulfonate (NaDBS) (e.g., 100 mM Sodium Dodecyl-Benzene-Sulfonate (NaDBS) (Sigma-Aldrich, St. Louis, Mo.)) was used. Pyrrole monomer (100 mM pyrrole monomers (Sigma-Aldrich, St. Louis, Mo.)) was used to form the electrically conductive monomer. Organic (Polystyrene), inorganic (Silicon), and biological (Yeast) particles were employed to demonstrate the flexibility of the process. Polystyrene and Silicon experience a positive DEP force at low frequencies, therefore frequencies in the range from 500 Hz to 1 KHz were employed for the AC signals applied to the electrodes. Viable biological cells experience negative DEP at low frequencies; hence the frequency was increased to 1 MHz when working with yeast cells. The amplitude of the AC electric potential (voltage) employed in the experiments was lower than 6 Vpp due to the second step of the process. DEP was induced for 20 seconds in the experiments in order to gather as many particles as possible over the electrodes. Right after this time, a DC offset signal was applied. The effect of this offset is not to modify the Dielectrophoretic response of the particles, but to initiate the electrodeposition of polypyrrole (PPy) over the electrodes. Since DEP never stops acting upon the particles, these are never released to the bulk of the solution, therefore the PPy layer permanently entraps the particles.

The DC offset has to be larger than the oxidation potential of the polymer to polymerize the pyrrole monomers, but small enough to avoid electrolysis at the electrodes of the electrochemical cell. Electrolysis occurs with DC potentials when the signal amplitude is larger than the electrochemical stability window of the material the electrode is made of, but it also occurs with small frequency AC signals (usually around a few KHz and below). For polystyrene beads and silicon particles employed in the experiments, the frequency employed to produce positive DEP falls into this electrolysis frequency range. The optimal parameters can be found through trial and error for each type of particle. All the electric signals were obtained from a synthesized function generator DS345 (Stanford Research Systems, Sunnyvale, Calif.) with frequency range from 1 Hz to 33 MHz and output voltage up to 20 Vpp. Electrical connection to the chip was achieved using alligator clips.

Figure 4:
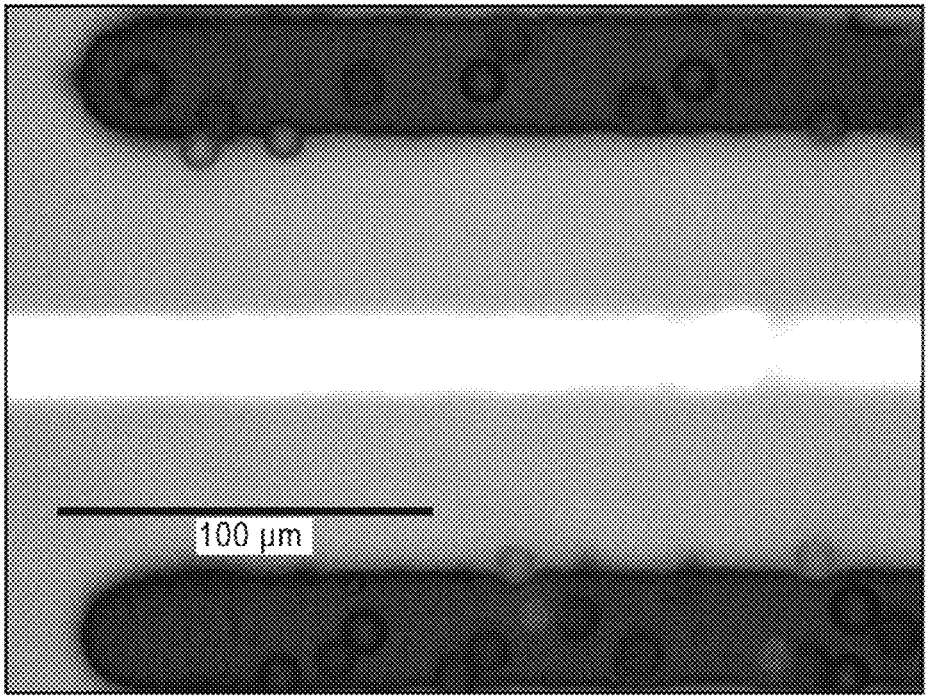
FIG. 4 illustrates an image of 10 μm polystyrene beads trapped by PPy. Darker beads are fully covered by PPy and the clearer beads are adhered but have not been completely entrapped by the polymer layer.

Polystyrene beads of 10 μm in diameter were used for initial experiments. An AC signal of 6 Vpp and 500 Hz was employed to induce DEP on the beads. After 20 seconds of particle trapping, a DC offset of 0.6V was applied to the signal in order to start the polymerization of the pyrrole monomers. This offset was fixed at that value for 40 seconds and then the excitation signal was turned off. The alligator clips were then unplugged from the chip. The chip was rinsed with DI water for 30 seconds in order to remove the remains of Pyrrole solution. The chip was then mounted under an Eclipse LV100 optical microscope (Nikon Instruments Inc., Melville, N.Y.) with an attached SPOT RT KE CCD camera (Diagnostic Instruments Inc., Sterling Heights, Mich.). FIG. 4 illustrates an image of 10 μm polystyrene beads trapped by PPy. Darker beads are fully covered by PPy and the clearer beads are adhered but have not been completely entrapped by the polymer layer.

Figure 5:
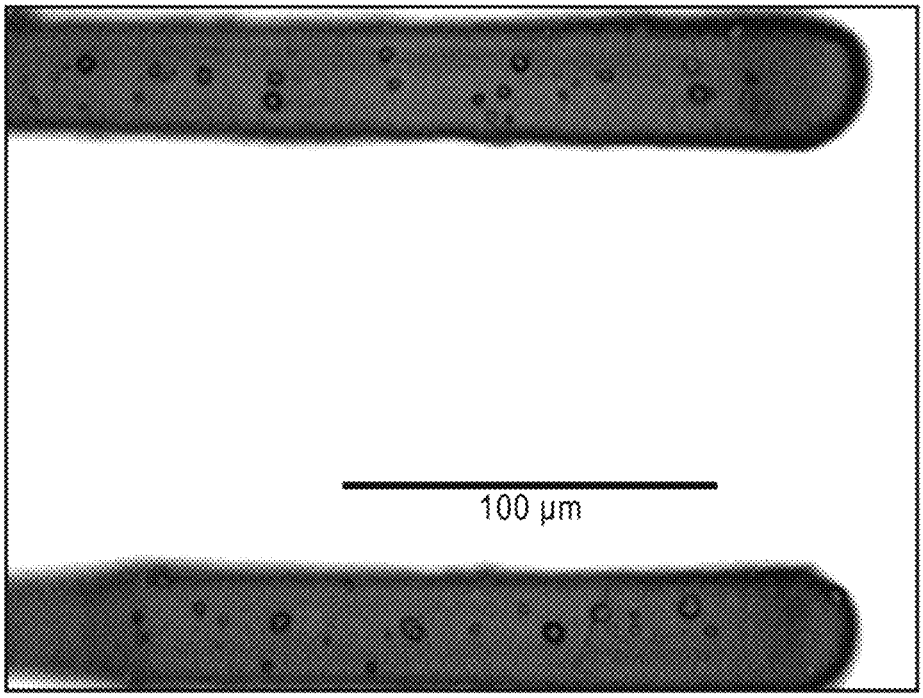
FIG. 5 illustrates an image of silicon microparticles with average characteristic dimension of around 5 μm adhered to the electrodes through a layer of PPy.

Silicon particles were also used to be incorporated using the process. In contrast to polystyrene, which is an organic material, silicon is inorganic. Including different types of materials into the process, i.e., organic, inorganic, biological materials, is important because of the several applications the invention may find. Silicon particles with an average characteristic dimension of 5 μm were suspended in a solution of 100 mM pyrrole monomers and 100 mM NaDBS. An AC signal of 4 Vpp and 600 Hz was employed to induce DEP in the particles. After 20 seconds of particle trapping, a DC offset of 0.6V was applied to the signal to initiate PPy deposition. The offset was applied for a period of 40 seconds after which the excitation signal was turned off. The chip was thoroughly rinsed with DI water in order to remove the remains of pyrrole solution as well as non-trapped particles. Visualization of the results was achieved through the LV 100 optical microscope attached to the SPOT RT KE CCD camera. FIG. 5 illustrates an image of silicon microparticles with average characteristic dimension of around 5 μm adhered to the electrodes through a layer of PPy.

Figure 6:
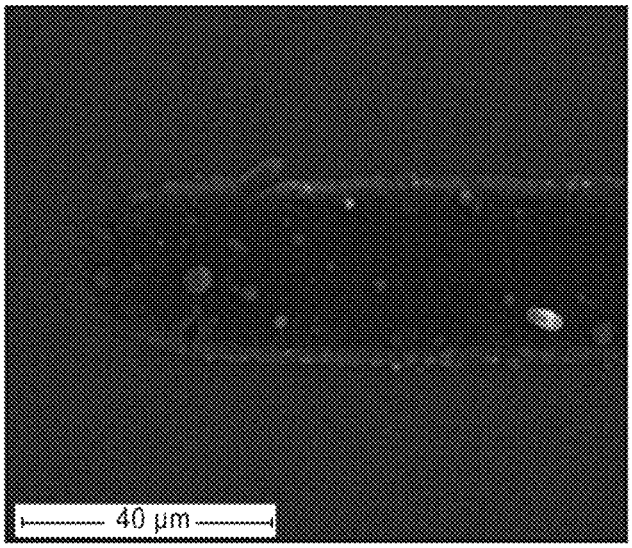
FIG. 6 illustrates an image of yeast cells incorporated into the process.

Biological particles were also employed to demonstrate the flexibility of the process and potential uses in biotechnology applications. *Saccharomyces Cerevisiae* (baking yeast) were permanently entrapped in PPy. The complex permittivity of live yeast is higher than that of the suspending solution at high frequencies; therefore, for DEP to pull yeast towards the electrodes, an AC signal of 6 Vpp with frequency of 1 MHz was employed as excitation source. The DEP force was induced over the particles without the influence of any DC offset for 20 seconds, then, to achieve permanent particle immobilization, a DC component of 0.6V was added to the excitation signal for 40 seconds to polymerize the Pyrrole monomers doped with NaDBS. FIG. 6 shows a scanning electron microscope (SEM) micrograph of both, completely entrapped and superficially adhered yeast. The chip was rinsed with DI water after the experiment to remove any fluid sample remains. As in the previous cases, this is explained by DEP acting on the particles during the complete 60 seconds of the experiment. Not only were particles attracted towards the electrodes during the first 20 seconds are covered with PPy, but also particles that are attracted at the same time that the PPy layer is being grown over the electrodes.

Figure 7:
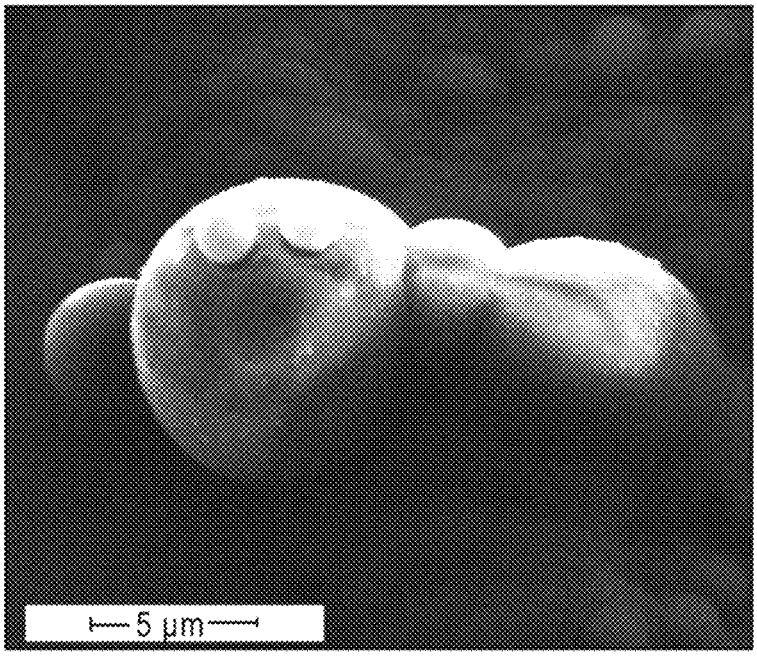
FIG. 7 illustrates an image of fractal geometries created though sequential repetition of the process with different particles. Particles of 10, 5 and 1 μm were held together with PPy.

Another important feature of the process described herein is the ability to develop fractal structures such as that illustrated in FIG. 3C. By carefully selecting the particles to be trapped in an ordered fashion, structures as the one shown in FIG. 7 can be fabricated. Three different particle diameters can be distinguished from the image, 5 μm, 2 μm, and 1 μm. The development of this fractal structure was achieved throughout sequential repetition of the two steps of the process (attracting particles to the electrodes and growing PPy over them). Three different samples were prepared for this experiment (each one contained a different particle type). The sample containing the 5 μm Polystyrene beads was employed first following the same guidelines of the experiment described above for 10 μm beads (FIG. 4). Then, after rinsing the chip, the second sample was employed to trap the 2 μm beads and then the process repeated again for the last sample containing 1 μm Polystyrene particles.

Finally, the addition of a pyrolysis step brings another interesting feature to the process. FIG. 8 shows an SEM micrograph of the surface of the carbonized electrodes. A uniform distribution of pores can be observed, all of which have an average diameter of 1 μm. To produce this uniform pore distribution, a layer of PPy entrapping 1 μm polystyrene beads was deposited over the electrodes. PPy is a carbon precursor, meaning that when subjected to a temperature of 900° C. under an inert environment (e.g., nitrogen gas flow) PPy will turn into carbon. The pattern left on electrode surface is a result of vaporized beads.

The process described herein has the following benefits including: 1) surface area increase can be tailored by selecting the beads of specific size; 2) wide selection of beads/particles/cells can be employed including organic, and inorganic materials as well as biological cells; 3) fractal geometry or hierarchical structures such as having larger beads and attaching to it beads of smaller size is possible with the described technique; 4) frequency selection allows to deposit beads of specific size out of multi-phase solution; 5) bead attachment is fairly strong compared to such techniques as solvent evaporation; 6) absence of high temperature step allows work with active biomolecules.

This process can find applications in numerous fields that require control over the surface area of the microfabricated structures. For instance, in electrochemistry, structures developed with this technology can be employed to make electrodes that can be used in batteries, fuel cells and other energy storage devices, solar cells, capacitors, and sensors. In biotechnology applications this technique can be used to trap beads functionalized with biomolecules onto the surface of electrodes. Sensor or biosensors can be constructed in this manner. The technique can also be used to fabricate actuators, scaffolds, drug delivery devices, and flexible electronic structures.

In some alternative embodiments, the applied AC signal that is used for DEP may be omitted entirely. For example, in one alternative embodiment, no AC signal is applied to the electrode 14. For example, the particles 20 may be charged particles that can be electrostatically attracted to or repulsed toward (with an opposing electrode) the working electrode 14. The charged particles 20 aggregate or accumulate near the electrode 14 whereby application of a DC voltage between the working electrode 14 and the counter electrode 22 result in electro-polymerization of the polymerizable monomer in solution. The electro-polymerization entraps the charged particles 20. In one aspect, the same DC voltage may be applied to the working electrode 14 to both attract the charged particles and electro-polymerize the monomer. However, different voltages may be used for attraction and electro-polymerization. For instance, a higher voltage may be used to attract the charged particles 20. The polymerizable monomer may be flowed into the system and a lower voltage is applied (so as to avoid hydrolysis) for electro-polymerization.

In another alternative embodiment that does not utilize an AC signal, the particles 20 may be magnetic. A separate magnet (e.g., electromagnet or permanent magnet) may be located at or adjacent to the working electrode 14 to attract the particles thereto. The working electrode 14 may also be made of a magnetic material (e.g., ferromagnetic material) that attracts the particles 20 via magnetic attraction. Magnetic repulsion may also be used to force particles 20 away from a repulsing magnet (not shown) toward the working electrode 14. Once the magnetic particles 20 have aggregated or accumulated near the electrode 14, application of a DC voltage between the working electrode 14 and the counter electrode 22 results in electro-polymerization of the polymerizable monomer in solution. The electro-polymerization entraps the magnetic particles 20.

In another alternative embodiment that does not utilize an AC signal, a suspension of particles 20 may sediment on the electrodes before a DC signal is applied to entrap the particles on the electrodes. Sedimentation of particles 20 may be accelerated by subjecting the device or solution to a centrifugal force. For example, the device may be spun in a centrifugal fashion (e.g., in a disc or the like) or within a centrifuge. Particles 20 having different sizes may be selectively deposited to create hierarchical structures. For example, a device may be spun at a lower rate (e.g., lower RPM) to deposit larger sized particles 20. These larger particles 20 can be entrapped by application of a DC voltage between the working electrode 14 and the counter electrode 22 to cause the electro-polymerization of the polymerizable monomer. Subsequent increase of the rotational frequency will cause sedimentation of smaller particles that can then be entrapped on the electrodes. Thus rotational frequency of the centrifuge may be used as a controlling parameter in selectively precipitating progressively smaller particles from the solution and DC bias can be used to entrap these particles onto the electrodes.

While embodiments of the present invention have been shown and described, various modifications may be made without departing from the scope of the present invention. The invention, therefore, should not be limited, except to the following claims, and their equivalents.

What is claimed is:

1. A method of creating a structure on an electrode comprising:

exposing an electrode to a solution containing a polymerizable monomer and particles;

applying an AC voltage to the electrode so as to induce positive DEP on the particles and draw the particles toward the electrode; and applying a DC offset voltage to the electrode while the AC voltage is applied to the electrode to form an electrically conductive polymer thereon from the polymerizable monomer, wherein the particles are entrapped on or within the polymer.

2. The method of claim 1, wherein the particles are organic.

3. The method of claim 1, wherein the particles are inorganic.

4. The method of claim 1, wherein the particles are biological.

5. The method of claim 1, wherein the particles are cells.

6. The method of claim 1, wherein the particles have functional chemical groups.

7. The method of claim 1, wherein the polymerizable monomer comprises pyrrole and the electrically conductive polymer comprises polypyrrole.

8. The method of claim 1, wherein the solution further comprises a dopant.

9. The method of claim 7, further comprising heating the structure to pyrolize the polypyrrole.

10. The method of claim 1, wherein the particles comprise nucleic acid.

11. The method of claim 1, wherein the particles comprise proteins.

12. The method of claim 1, wherein the particles comprise antibodies.

13. A method of creating a structure on an electrode comprising:

exposing an electrode to a first solution containing a polymerizable monomer and a first plurality of particles;

applying a first AC voltage to the electrode so as to induce positive DEP on the first plurality of particles and draw the first plurality of particles toward the electrode;

applying a DC offset voltage to the electrode to form a first layer of an electrically conductive polymer thereon from the polymerizable monomer, wherein the first plurality of particles are entrapped on or within the electrically conductive polymer of the first layer;

exposing the electrode to a second solution containing the polymerizable monomer and a second plurality of particles;

applying a second AC voltage to the electrode so as to induce positive DEP on the second plurality of particles and draw the second plurality of particles toward the electrode; and applying the second DC offset voltage to the electrode to form a second layer of an electrically conductive polymer thereon from the polymerizable monomer, wherein the second plurality of particles are entrapped on or within the electrically conductive polymer of the second layer.

14. The method of claim 13, wherein the particles of the first layer have a different size than the particles of the second layer.

15. The method of claim 13, wherein the particles of the first layer are larger in size than the particles of the second layer.

* * * * *